US007225749B2

(12) United States Patent
Boatman

(10) Patent No.: US 7,225,749 B2
(45) Date of Patent: Jun. 5, 2007

(54) TURRET MOORING SYSTEM FOR CONCRETE HULL VESSEL

(75) Inventor: L. Terry Boatman, Houston, TX (US)

(73) Assignee: SOFEC, Inc., Houston, TX (US)

( * ) Notice: Subject to any disclaimer, the term of this patent is extended or adjusted under 35 U.S.C. 154(b) by 48 days.

(21) Appl. No.: 10/900,494

(22) Filed: Jul. 26, 2004

(65) Prior Publication Data

US 2005/0061224 A1 Mar. 24, 2005

Related U.S. Application Data

(60) Provisional application No. 60/491,038, filed on Jul. 30, 2003.

(51) Int. Cl.
*B63B 21/00* (2006.01)

(52) U.S. Cl. ..... 114/230.12

(58) Field of Classification Search ..... 114/230.1, 114/230.12, 65 A, 65 R; 441/3, 4, 5
See application file for complete search history.

(56) References Cited

U.S. PATENT DOCUMENTS 4,011,826 A * 3/1977 Yee ..... 114/65 A
4,512,409 A * 4/1985 Gregory et al. ..... 166/352
5,201,275 A * 4/1993 Mo ..... 114/65 A
5,823,131 A * 10/1998 Boatman et al. ..... 114/230.12
5,893,784 A * 4/1999 Boatman ..... 441/3
6,477,974 B2 * 11/2002 Hobdy ..... 114/230.12
6,588,357 B1 * 7/2003 Hobdy ..... 114/230.1

OTHER PUBLICATIONS

Harris, R.J.S., et al., "Concrete FPSO", Offshore Technology Conference, OTC 8047, pp. 159-169 (May 1996).
Deserts, Loic, et al., "Disconnectable Concrete FPSO for Arctic Conditions", Proceedings of the Seventh (1997) International Offshore and Polar Engineering Conference, pp. 342-348 (May 1997).

* cited by examiner

*Primary Examiner*—Lars A. Olson
(74) *Attorney, Agent, or Firm*—Henry C. Query, Jr.

(57) ABSTRACT

A turret mooring system for a vessel which includes a concrete hull and a moonpool which extends generally vertically through the hull comprises a turret which is positioned in the moonpool, an upper bearing substructure which is mounted to the hull proximate an upper end of the moonpool, and an upper bearing which includes a non-rotatable part that is connected to an upper end portion of the turret and a rotatable part that is connected to the upper bearing substructure. Thus, the turret is rotatably connected to the hull via the upper bearing and the upper bearing substructure.

27 Claims, 3 Drawing Sheets

TURRET MOORING SYSTEM FOR CONCRETE HULL VESSEL

This application is based on and claims the benefit of U.S. Provisional Patent Application No. 60/491,038, which was filed on Jul. 30, 2003.

BACKGROUND OF THE INVENTION

The present invention relates to a mooring system for a floating production, storage and offloading vessel ("FPSO" or "FSO"). More specifically, the invention relates to a mooring system for an FPSO which comprises a concrete hull.

FPSO's are used to produce, store, and offload hydrocarbons from subsea wells. A typical FPSO includes a relatively large floating hull which has a moonpool that extends vertically through the hull. The FPSO is normally moored to the sea floor using a mooring turret which is disposed in the moonpool and secured to the sea floor with a number of anchor chains. In addition, the turret is often rotatably connected to the vessel in order to allow the vessel to weathervane about the turret in response to wind or current affects.

Concrete has long been a preferred material for submerged or partially submerged fixed structures because of its low cost and inherent corrosion resistance. In addition, although concrete has been used as a hull material for floating transport vessels, such as conventional ships and barges, steel is preferred for these applications since steel vessels typically have a smaller displacement and therefore a greater fuel economy. However, because FPSO's remain essentially stationary during normal use, fuel economy is not an issue. Therefore, concrete is considered a viable alternative for FPSO hulls. Furthermore, concrete hulls can be constructed at limited facilities on the coasts and in the protected waters of undeveloped countries, where conventional steel shipyards normally do not exist.

SUMMARY OF THE INVENTION

In accordance with the present invention, a turret mooring system is provided for a vessel which includes a concrete hull, a moonpool which extends generally vertically through the hull, and a moonpool wall which is defined by the moonpool. The turret mooring system comprises a turret which is positioned in the moonpool, an upper bearing substructure which is mounted to the hull proximate an upper end of the moonpool, and an upper bearing which includes a non-rotatable part that is connected to an upper end portion of the turret and a rotatable part that is connected to the upper bearing substructure. Thus, the turret is rotatably connected to the hull via the upper bearing and the upper bearing substructure. In this embodiment, the upper bearing substructure is preferably mounted to the moonpool wall or to an upper shoulder which is formed in the moonpool wall.

In accordance with another embodiment of the invention, the turret mooring system also includes a number of spring members which are supported on the upper bearing substructure, and a bearing support ring which is positioned around the upper end portion of the turret and is supported on the spring members. Also, the rotatable part of the upper bearing is connected to the bearing support ring. Thus, the rotatable part of the upper bearing is connected to the upper bearing substructure through the bearing support ring and the spring members.

In accordance with a further embodiment of the invention, the turret mooring system further comprises a lower bearing frame which is mounted to the hull proximate a lower end of the moonpool, and means supported on the lower bearing frame for slidably engaging a lower end portion of the turret. In this embodiment, the lower bearing frame is preferably mounted to the moonpool wall or to a lower shoulder which is formed in the moonpool wall. In addition, the slidably engaging means may comprise a number of bearing segments, and the turret mooring system may also comprise a bearing surface which is located on the turret and which is slidably engaged by the bearing segments.

In accordance with yet another embodiment of the invention, the turret mooring system comprises a chain table which is supported on a lower end portion of the turret. In addition, the bottom of the chain table is preferably located above the bottom of the hull. Furthermore, the outer diameter of the chain table is ideally less than the inner diameter of the lower shoulder, the outer diameter of the lower bearing frame is ideally less than the inner diameter of a portion of the moonpool wall located above the lower shoulder, and the outer diameter of the upper bearing substructure is ideally less than the inner diameter of a portion of the moonpool wall located above the upper shoulder.

Thus, the turret mooring system of the present invention provides a simple yet effective means for rotatably connecting a turret to the concrete hull of a vessel. In addition, since the bottom of the chain table is preferably located above the bottom of the hull, the turret mooring system will not be damaged should the vessel contact the sea floor. Also, since the chain table, the lower bearing frame and the upper bearing substructure are smaller than the associated portions of the moonpool, the turret mooring system can be installed by lowering these components into the moonpool from above the vessel.

These and other objects and advantages of the present invention will be made apparent from the following detailed description, with reference to the accompanying drawings.

DETAILED DESCRIPTION OF THE PREFERRED EMBODIMENTS

Figure 1:
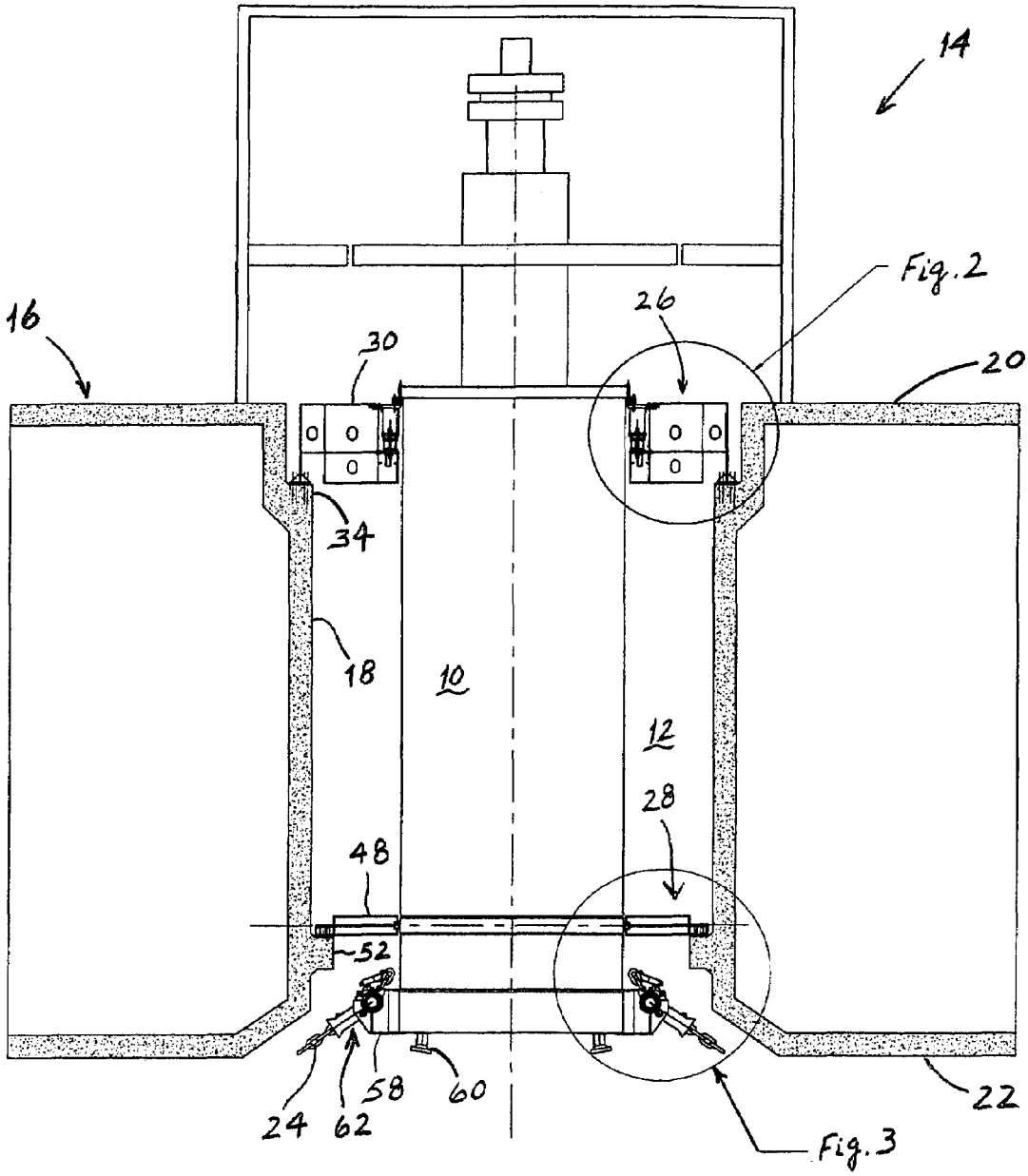
FIG. 1 is a partially schematic cross sectional view of a turret mooring system according to one embodiment of the present invention.

Referring to FIG. 1, the turret mooring system of the present invention comprises a turret 10 which is positioned in a moonpool 12 of a vessel 14, such as an FPSO. In accordance with the present invention, the vessel 14 comprises a hull 16 which is constructed of concrete, and the moonpool 12 is defined by a moonpool wall 18 which extends generally vertically through the hull 16 from the main deck 20 to the keel or bottom 22 of the vessel. The moonpool 12 may be located on the forward-to-aft centerline of the hull 16 between the forward and aft perpendiculars of the vessel 14. In addition, the moonpool 12 may have any suitable cross sectional configuration, such as circular, prismatic or hexagonal.

The turret 10 is preferably fabricated from steel and is anchored to the seafloor via a plurality of anchor chains 24. In addition, the turret 10 is rotatably supported in the moon pool 12 with an upper bearing assembly 26 and a lower bearing assembly 28. The upper bearing assembly 26 functions to transmit both vertical and lateral mooring loads from the turret 10 to the hull 16, while the lower bearing assembly 28 functions to transmit only lateral mooring loads from the turret to the hull. Thus, the vessel 14 is allowed to weathervane around the turret 10 while still being firmly anchored to the sea floor.

Figure 2:
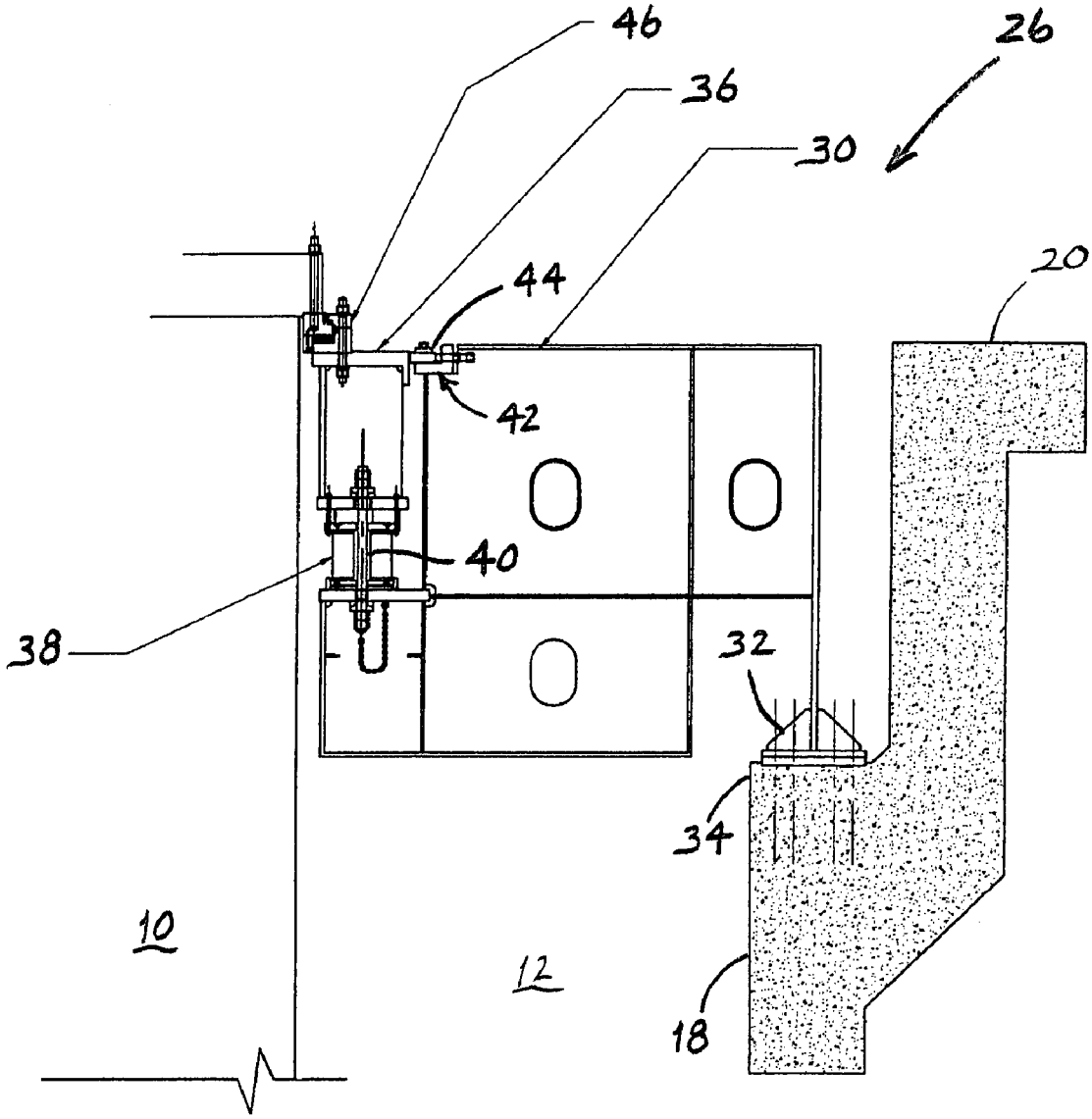
FIG. 2 is an enlarged cross sectional view of the upper bearing assembly of the turret mooring system shown in FIG. 1.

Referring also to FIG. 2, the upper bearing assembly 26 comprises a cylindrical upper bearing substructure 30 which is positioned around an upper end portion of the turret 10 and includes a central axis that is aligned with the longitudinal axis of the moonpool 12. The upper bearing substructure 30 is preferably fabricated from steel and ideally includes a circular footing 32 which is secured with anchor bolts or other suitable means to an upper shoulder 34 that is formed in the moonpool wall 18. Alternatively, the upper bearing substructure 30 could be bolted or welded to one or more appropriate steel support members which are embedded in the concrete of the moonpool wall 18. In addition, the upper bearing substructure 30 may be mounted to the hull 16 either below, level with, or above the main deck 20.

The upper bearing assembly 26 may also comprise an annular, preferably steel bearing support ring 36 which is positioned around the upper end portion of the turret 10. The bearing support ring 36 is vertically supported on the upper bearing substructure 30 with a plurality of spring members 38 and may be connected to the upper bearing substructure with a number of bolts 40. The spring members 38 are preferably made of an elastomeric material, but they may alternatively comprise steel disc springs or any other suitable springs. The bearing support ring 36 is ideally laterally supported relative to the upper bearing substructure 30 by a lateral support assembly 42. The lateral support assembly 42 comprises one or more low friction sliding elements 44 which bear against the support ring 36 and are preferably adjustably connected to the upper bearing substructure 30. However, the sliding elements 44 courd be replaced with any other suitable low-friction bearing devices or with elastomeric spring members which deflect in shear to allow the bearing support ring 36 to move vertically but which are relatively stiff in compression to limit the movement of the bearing support ring horizontally.

In the embodiment of the invention which is illustrated in the Figures, the turret 10 is rotatably connected to the bearing support ring 36 by an upper bearing 46. The upper bearing 46 includes a rotatable part which is bolted or otherwise attached to the bearing support ring 36 and a non-rotatable part which is attached to the turret 10 by conventional means. As will be apparent to those skilled in the art, the non-rotatable part of the upper bearing 46 remains stationary while the rotatable part moves with the vessel 14 as it weathervanes around the turret 10. The upper bearing 46 preferably comprises a conventional roller bearing, but in certain embodiments may comprise low-friction sliding elements or any other suitable type of bearing.

In operation, vertical and lateral mooring loads are transferred from the upper end portion of the turret 10 to the bearing support ring 36 through the upper bearing 46. From the bearing support ring 36, these loads are transferred through the spring members 38 and the lateral support assembly 42 to the upper bearing substructure 30. From the upper bearing substructure 30, the mooring loads are transferred through the footing 32 to the moonpool wall 18. The spring members 38 provide additional flexibility between the turret 10 and the footing 32, and this flexibility serves to limit the bending moment loads on the hull 16 due to any non-concentricity of the upper bearing 46 with the lower bearing assembly 28.

As an alternative to the arrangement just described, the rotatable part of the upper bearing 46 may be attached directly to the upper bearing substructure 30. In this embodiment, the upper bearing substructure 30 is ideally designed to be relatively flexible in order to limit the bending moment loads due to any non-concentricity between the upper and lower bearing assemblies 26, 28.

Figure 3:
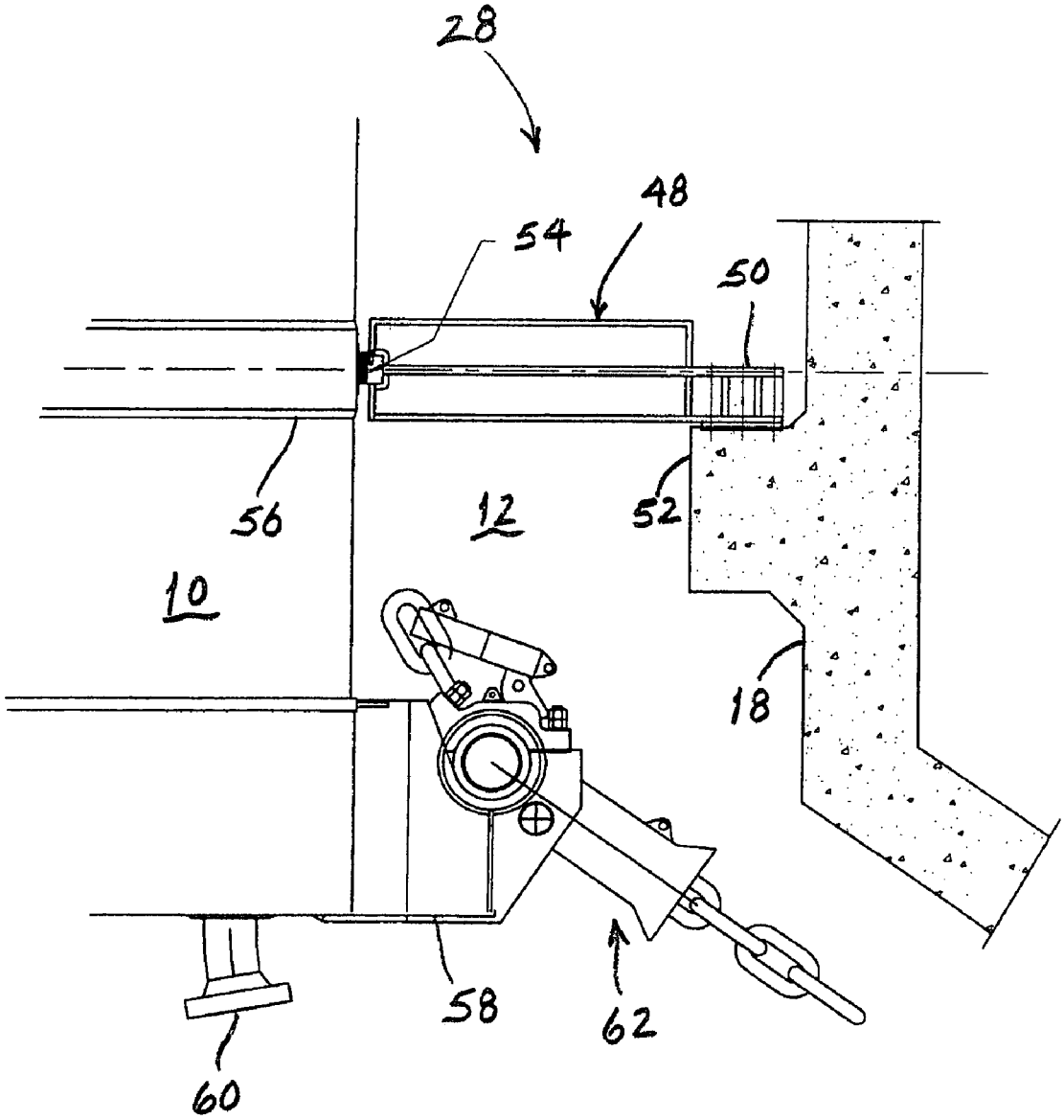
FIG. 3 is an enlarged cross sectional view of the lower bearing assembly of the turret mooring system shown in FIG. 1.

Referring also to FIG. 3, the lower bearing assembly 28 comprises a circular lower bearing frame 48 which is positioned around a lower end portion of the turret 10. The lower bearing frame 48 is optimally made of steel and includes a base portion 50 which is connected via anchor bolts or other suitable means to a lower shoulder 52 that is formed on the moonpool wall 18. Alternatively, the lower bearing frame 48 could be bolted or welded to one or more appropriate steel support members which are embedded in the concrete of the moonpool wall 18. The lower bearing frame 48 supports a number of ideally removable low-friction bearing segments 54 which slidably engage the turret 10. The bearing segments 54 are preferably made from a low-friction, self-lubricating material such as a laminate composite plastic. Alternatively, the bearing segments 54 could be made from a lubricant-impregnated bronze or any other suitable low-friction material.

The lower bearing assembly 28 ideally also comprises a corrosion resistant bearing surface 56 which is located on the outer diameter of the turret 10 and against which the bearing segments 54 are permitted to slide. The bearing surface 56 is preferably made from stainless steel or Inconel, but may alternately be made from any suitable material. Alternatively, the bearing segments 54 and the bearing surface 56 could be replaced with a rolling bearing or any other suitable type of bearing.

In operation, lateral mooring loads are transferred from the lower end portion of the turret 10 through the bearing segments 54 to the lower bearing frame 48. From the lower bearing frame 48 these loads are transferred through the base portion 50 to the moonpool wall 18.

Referring also to FIG. 1, the bottom of the turret 10 may include a chain table 58 and a number of riser connection flanges 60. Each anchor chain 24 is connected to the chain table 58 with a corresponding chain support 62. Each chain support 62 includes a hawse pipe for guiding the chain 24 and a ratcheting chain stopper for adjusting the tension in the chain tension. In addition, each chain support 62 is trunnion mounted and pivots about a horizontal axis on a self-lubricated, low friction bearing. Alternatively, the chains 24 could be directly and non-adjustably connected to the chain table 58.

The turret 10 is preferably mounted in the moonpool 12 such that the chain table 58, the chain supports 62, and the riser connection flanges 60, and any other appendages on the lower end of the turret, are elevated above the keel 22. In the event that the water depth is insufficient for the vessel 14, this arrangement prevents these components from being damaged due to contact with the sea floor.

In accordance with a further embodiment of the invention, the turret 10 can ideally be installed in the vessel 14 after the concrete moonpool area of the hull 16 has been completed. As shown in FIG. 1, the inner diameter of the lower shoulder 52 is greater than the outer diameter of the chain table 58 and its associated components. In addition, inner diameter of the moonpool wall 18 is greater than the outer diameter of the lower bearing frame 48. Also, the inner diameter of the portion of the moonpool wall above the upper shoulder 34 is greater than the outer diameter of the upper bearing substructure 30. Therefore, the components of the turret 10 and the upper and lower bearing assemblies 26, 28 can be installed from the top of the moonpool 12 and lowered into place from the upper deck 20. Moreover, these components may be installed in modules which are lowered into the moonpool 12 onto suitable temporary supports and then fastened together by welding, bolting, or any other suitable means.

It should be recognized that, while the present invention has been described in relation to the preferred embodiments thereof, those skilled in the art may develop a wide variation of structural and operational details without departing from the principles of the invention. Therefore, the present application should be construed to cover all equivalents falling within the true scope and spirit of the invention.

What is claimed is:

1. In combination with a vessel which includes a concrete hull, a moonpool which extends generally vertically through the hull, and a moonpool wall which is defined by the moonpool, the improvement comprising a turret mooring system which comprises:

a turret which is positioned in the moonpool;

an upper bearing substructure which is mounted to an upper shoulder which is formed in the moonpool wall;

an upper bearing which includes a non-rotatable part that is connected to an upper end portion of the turret and a rotatable part that is connected to the upper bearing substructure; and a lower bearing frame which is mounted to a lower shoulder which is formed in the moonpool wall;

wherein the outer diameter of the upper bearing substructure is greater than the inner diameter of the upper shoulder; and wherein the outer diameter of the lower bearing frame is less than the inner diameter of the upper shoulder but greater than the inner diameter of the lower shoulder.

2. The combination of claim 1, further comprising:

a number of spring members which are supported on the upper bearing substructure; and a bearing support ring which is positioned around the upper end portion of the turret and is supported on the spring members;

wherein the rotatable part of the upper bearing is connected to the bearing support ring.

3. The combination of claim 2, wherein the spring members are comprised of an elastomeric material.

4. The combination of claim 2, wherein the spring members comprise metallic disc springs.

5. The combination of claim 2, further comprising means for laterally supporting the upper end portion of the turret relative to the hull.

6. The combination of claim 5, wherein the lateral support means comprises a number of elastomeric spring members which are disposed between the bearing support ring and the upper bearing substructure.

7. The combination of claim 5, wherein the lateral support means comprises a number of sliding elements which are connected to the upper bearing substructure and which bear against the bearing support ring.

8. The combination of claim 7, wherein the sliding elements are adjustably connected to the upper bearing substructure.

9. The combination of claim 1, further comprising:

means supported on the lower bearing frame for slidably engaging a lower end portion of the turret.

10. The combination of claim 9, wherein the lower bearing frame is attached to a support member which is embedded in the moonpool wall.

11. The combination of claim 9, wherein the slidably engaging means comprises a number of bearing segments.

12. The combination of claim 11, wherein the bearing segments are made from a self-lubricating material.

13. The combination of claim 11, wherein the bearing segments are made from a laminate composite plastic material.

14. The combination of claim 11, wherein the bearing segments are made from a lubricant-impregnated bronze material.

15. The combination of claim 11, wherein the bearing segments are removably supported on the lower bearing frame.

16. The combination of claim 9, further comprising a bearing surface which is located on the turret and which is slidably engaged by the slidably engaging means.

17. The combination of claim 16, wherein the bearing surface is comprised of a corrosion resistant material.

18. The combination of claim 1, further comprising a chain table which is supported on a lower end portion of the turret and which comprises a bottom that is located above the bottom of the hull.

19. The combination of claim 1, further comprising:

means supported on the lower bearing frame for slidably engaging a lower end portion of the turret; and a chain table which is supported on the lower end portion of the turret.

20. In combination with a vessel which includes a concrete hull, a moonpool which extends generally vertically through the hull, and a moonpool wall which is defined by the moonpool, the improvement comprising a turret mooring system which comprises:

a turret which is positioned in the moon pool;

an upper bearing substructure which is mounted to the hull proximate an upper end of the moonpool; and an upper bearing which includes a non-rotatable part that is connected to an upper end portion of the turret and a rotatable part that is connected to the upper bearing substructure;

wherein the turret is rotatably connected to the hull via the upper bearing and the upper bearing substructure;

wherein the upper bearing substructure is mounted to the moonpool wall;

wherein the upper bearing substructure is mounted to an upper shoulder which is formed in the moonpool wall; and wherein the upper bearing substructure includes a circular footing which is secured to the upper shoulder.

21. In combination with a vessel which includes a concrete hull, a moonpool which extends generally vertically through the hull, and a moonpool wall which is defined by the moonpool, the improvement comprising a turret mooring system which comprises:

a turret which is positioned in the moonpool;

an upper bearing substructure which is mounted to the hull proximate an upper end of the moonpool; and an upper bearing which includes a non-rotatable part that is connected to an upper end portion of the turret and a rotatable part that is connected to the upper bearing substructure;

wherein the turret is rotatably connected to the hull via the upper bearing and the upper bearing substructure;

wherein the upper bearing substructure is mounted to the moonpool wall; and wherein the upper bearing substructure is attached to a support member which is embedded in the moonpool wall.

22. In combination with a vessel which includes a concrete hull, a moonpool which extends generally vertically through the hull, and a moonpool wall which is defined by the moonpool, the improvement comprising a turret mooring system which comprises:

a turret which is positioned in the moonpool;

an upper bearing substructure which is mounted to the hull proximate an upper end of the moonpool;

an upper bearing which includes a non-rotatable part that is connected to an upper end portion of the turret and a rotatable part that is connected to the upper bearing substructure;

wherein the turret is rotatably connected to the hull via the upper bearing and the upper bearing substructure;

a lower bearing frame which is mounted to the hull proximate a lower end of the moonpool; and means supported on the lower bearing frame for slidably engaging a lower end portion of the turret;

wherein the lower bearing frame is mounted to the moonpool wall; and wherein the lower bearing frame is mounted to a lower shoulder which is formed in the moonpool wall.

23. The combination of claim 22, wherein the lower bearing frame includes a base portion which is secured to the lower shoulder.

24. In combination with a vessel which includes a concrete hull, a moonpool which extends generally vertically through the hull, and a moonpool wall which is defined by the moonpool, the improvement comprising a turret mooring system which comprises:

a turret which is positioned in the moonpool;

an upper bearing substructure which is mounted to the hull proximate an upper end of the moonpool;

an upper bearing which includes a non-rotatable part that is connected to an upper end portion of the turret and a rotatable part that is connected to the upper bearing substructure;

wherein the turret is rotatably connected to the hull via the upper bearing and the upper bearing substructure;

a lower bearing frame which is mounted to the hull proximate a lower end of the moonpool;

means supported on the lower bearing frame for slidably engaging a lower end portion of the turret; and a chain table which is supported on the lower end portion of the turret;

wherein the upper bearing substructure is mounted on an upper shoulder in the moonpool wall and the lower bearing frame is mounted on a lower shoulder in the moonpool wall.

25. The combination of claim 24, wherein the outer diameter of the chain table is less than the inner diameter of the lower shoulder.

26. The combination of claim 25, wherein the outer diameter of the lower bearing frame is less than the inner diameter of a portion of the moonpool wall located above the lower shoulder.

27. The combination of claim 26, wherein the outer diameter of the upper bearing substructure is less than the inner diameter of a portion of the moonpool wall located above the upper shoulder.

* * * * *